United States Patent [19]

Svensson

[11] Patent Number: 4,637,167

[45] Date of Patent: Jan. 20, 1987

[54] DOOR

[75] Inventor: Torsten Svensson, Sollentuna, Sweden

[73] Assignee: Termofrost Sweden AB, Spanga, Sweden

[21] Appl. No.: 700,314

[22] Filed: Feb. 11, 1985

[51] Int. Cl.[4] ..... E05F 1/10

[52] U.S. Cl. ..... 49/386; 49/388; 49/501

[58] Field of Search ..... 49/386, 501, 388; 312/138 R, 139

[56] References Cited

U.S. PATENT DOCUMENTS

| | | | |
|---|---|---|---|
| 3,507,074 | 4/1970 | Gallegos | 49/386 |
| 3,629,972 | 12/1971 | Rehberg et al. | 49/386 X |
| 3,780,472 | 12/1973 | Biebuyck | 49/501 |
| 4,145,844 | 3/1979 | Kaspar | 49/386 |
| 4,223,482 | 9/1980 | Barroero et al. | 49/386 |
| 4,378,658 | 4/1983 | DeLorean | 49/386 X |

*Primary Examiner*—Philip C. Kannan

*Attorney, Agent, or Firm*—Nies, Webner, Kurz & Bergert

[57] ABSTRACT

A door for refrigerating and freezing chambers, comprising a door frame supporting one or more glass panes for exposing refrigerated or frozen goods in said chamber through the door. According to the invention, the door frame comprises a section (6) capable to support the glass (4) associated with the door (1) along only one vertical edge (7) of the glass (4), at which edge (7) the door (1) is intended to be hingedly suspended in a door case. An inner longitudinal cavity (10) is located along the entire length of the section (6), in which cavity (10) a torsion spring (11) extends substantially along the entire length of the section (6), which torsion spring (11) is capable to be locked at one end relative to the section (6) and at its other end relative to said door case.

3 Claims, 4 Drawing Figures

DOOR

This invention relates to a glazed door for refrigerating or freezing chambers of the type used in everyday commodities trade, especially in grocery shops.

Refrigerating or freezing chambers are by such doors partitioned off from the remaining shop space, at the same time as the goods in the refrigerating or freezing chamber are exposed to the customers in the shop. Such doors are not relatively usually installed in grocery shops.

One great desire is that the transparent surface of such a door should cover as great a portion of the door as possible, whereby an exposing surface as great as possible is obtained. The aim, therefore, is that the door frames should be as narrow as possible.

Such doors, however, must be self-closing and in their closed position tightly abut with a certain force a sealing strip against the door case, in order to effectively seal the refrigerating or freezing chamber when the door is closed.

The requirement on the doors to be self-closing has enforced a relatively coarse frame on the side where the door is suspended, in order to provide sufficient space for necessary springs. Such doors, furthermore, are relatively wide, for example 600–800 mm, and at the same time must be provided with at least two glass panes for having a sufficient insulating effect. This has implied, that also the remaining part of the frame had to be designed sturdy so as to be capable to support the glass panes.

The aforesaid desire is met by the present invention, which offers a door having a very thin frame in relation to the door size. The door is at the same time self-closing and can support a single pane or an insulating pane comprising two or more panes.

The present invention relates to a door for refrigerating and freezing chambers, comprising a door frame, which supports one or more glass panes so as to expose through the door refrigerated or frozen goods in said chambers. The invention is characterized in that the door frame comprises a section capable to support the glass associated with the door along only one vertical edge of the glass, at which edge the door is intended to be hingedly suspended in a door case, and that an inner longitudinal cavity is located along the entire length of the section, in which cavity a torsion spring extends along substantially the entire length of the section, which torsion spring is capable to be locked at one end relative to the section and at its other end relative to said door case.

Figure 1:
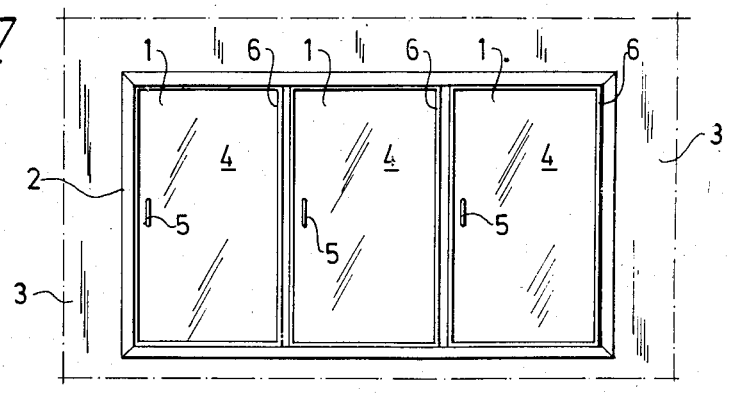
Figure 2:
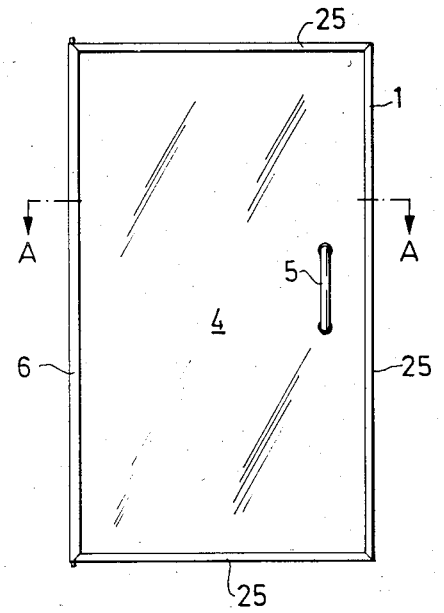
Figure 4:
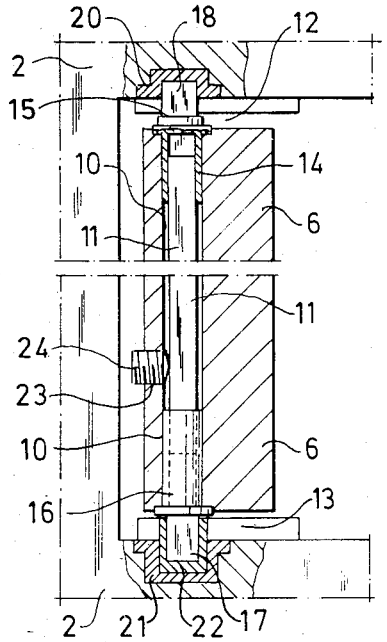
Figure 3:
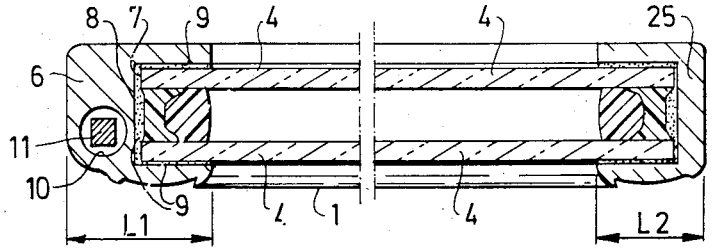

The invention is described in greater detail in the following, with reference to the accompanying drawing, in which FIG. 1 is a view of three doors mounted in a door case, FIG. 2 shows a door according to the invention on an enlarged scale, FIG. 3 is a section along the line A—A in FIG. 2, FIG. 4 shows portions of a vertical section at the upper and, respectively, lower attachment of the door in the door case.

FIG. 1 is a view of three doors 1 mounted in a door case 2 in a wall 3, which separates a refrigerating or freezing chamber from a shop space or the like. The doors comprise one or more glass panes 4 for exposing the goods in the refrigerating or freezing chamber. Handles 5 are provided for opening the doors 1.

The doors 1 are supported by a door frame, which comprises a straight section 6 designed so as to support the glass 4 along only one vertical edge 7 of the glass 4. At said edge 7 the door is intended to be suspended on the door case 2.

The glass 4 preferably is fixed in the section 6 by glueing. For this purpose the section 6 is formed along its entire length with a groove 8 or U-shaped cross-section. The glue 9 is marked by dotted area in FIG. 3. In FIG. 3 the glass is a two-pane insulating glass of conventional design.

Along the entire length of the section 6 an inner cavity 10 is provided, in which a torsion spring 11 extends substantially along the entire length of the section 6. The torsion spring 11 is capable to be locked at one end relative to the section 6 and at its other end relative to the door case 2, as shown by way of example in FIG. 4.

According to a preferred embodiment, the torsion spring 11 has square cross-section. Square cross-section in combination with a great length implies, that the torsion spring delivers uniform spring force, i.e. uniform resistance to turning the door in all its turning positions. It is hereby achieved that the door even in its closed position abuts the door case with sufficient force and at the same time is not slow to open. It may be mentioned that in the case of short tension springs, when the force in closed position shall be sufficient, the resistance to maintain the door in open position is troublesome great.

In FIG. 4 portions of a vertical section at the upper 12 and, respectively, lower 13 attachment of the door 1 in the door case 2 are shown. The torsion spring 11 is at least at one end 12 connected to a nipple 14,15 or the like formed as a journal 18, which is intended to be suspended non-rotary in a corresponding bearing plate 20 in the door case 2.

According to a preferred embodiment, also the other end of the torsion spring 11 is connected to a nipple 16 or the like, which is intended to be suspended pivotally in a corresponding bearing plate 21 in the door case 2.

The nipples 14–16, of course, can be designed in any suitable way, irrespective of that one end of the torsion spring shall be connected non-rotary to the door case 2, and the other end shall be connected non-rotary to the section 6.

At the embodiment in FIG. 4, the nipple at the upper end consists of two nipples 14,15.

At one nipple 14 the square torsion spring 11 projects into a square bore. The second, upper, nipple 15 is square and projects into the lower nipple 14. The upper portion of the upper nipple is a square journal 18, which is attached non-rotary in the bearing plate 20 in the door case 2. At its lower end the torsion spring 11 is connected to the nipple 16, which at its upper portion has a square bore, and which at its lower end has a square journal 17. Said journal 17 is inserted into a bushing 22, which is square internally and round externally. The bushing 22 is inserted down into the bearing place 21 in the door case 2.

In order to attach the torsion spring 11 non-rotary relative to the section 6, a threaded bore 23 is made in the section 6 close to its lower end. A screw 24, preferably a so-called socket head cap screw, is screwn into the bore 23 and intended to act against the torsion spring 11.

When the spring is to be stretched, its upper end is locked by the journal 18. The screw 24 is loosened, and the spring is turned in that the journal 17 is turned by means of a suitable tool, whereafter the screw is tightened.

By designing the attachment members in the form of nipples at the ends of a long torsion spring, the section 6 can be designed extremely tenderly, at the same time as a good spring action is obtained. The dimension L1 in FIG. 3 is only a few centimeters. A dimension used at test doors is 28 mm at a total door width of 700 mm.

About the remaining three sides of the glass 4 a lightweight and tender strip 25 can be attached, which is not required to have any carrying capacity. At certain designs, a strip of only thin stainless sheet metal can be used. The dimension L2 of the strip 25 in FIG. 3, of course, can be smaller than the dimension L1. The dimension L2, for example, can be 10–20 mm.

A sealing strip in the form of a so-called magnet strip preferably is provided on the strip 25 or door case in order to ensure good abutment between frame and case in closed position of the door.

It is fully obvious, that such a door frame in the form of said section 6 and strips 25 implies, that substantially the entire surface of the door is transparent.

The suspension of the door, furthermore, and its built-in springs imply that obscuring external spring attachments can be avoided, which also implies, that door case pillars located between two adjacent doors can be designed narrower than before, whereby the surface of the entire door arrangement substantially is transparent.

Due to the very narrow door case, the said handles 5 are attached directly to the glass pane located farthest away from the refrigerating or freezing chamber. The handle preferably is of transparent glass and glued onto the pane with a transparent glue, which additionally contributes to an increase of the exposing surface.

It was mentioned above, that the section 6 is glued onto the glass 4.

Another attachment method, of course, can be used, for example a screw connection.

As mentioned above, also the attachment of the torsion spring in the door case and, respectively, door can be varied in several ways. Such modifications are considered comprised in the present invention.

The invention, thus, must not be regarded restricted to the embodiment described above, but can be varied within the scope of the attached claims.

I claim:

1. A door for refrigerating and freezer chambers, comprising a door frame, which supports at least one glass pane for exposing through the door refrigerated or frozen goods in said chamber, which door frame at one vertical edge (7), via an elongate first frame section, is intended to be hingedly suspended in a door case (2) and which door frame and door case cooperate with a torsion spring (11) having two ends, said torsion spring (11) being locked at one of its ends relative to the door frame and at the other of its ends relative to the door case, wherein nipples or the like connect to the torsion spring at its upper end (12) and its lower end (13), said nipples or the like, formed as journals (17,18), cooperate with associated bearing means (20, 21) in the door case (2) to thereby pivotally suspend said door; characterized in that means in said door rigidly secure said one vertical edge (7) of said first door frame section (6) to and along only one edge of the glass pane in a U-shaped groove (8) provided along the entire length of said first frame section (6) to provide the sole support for the door; said first frame section comprising an inner longitudinal cavity (10) provided along the entire length of the section, in which cavity said torsion spring extends along substantially the whole length of the section (6); and the remainder of the door frame comprises at least one thin non load bearing strip (25) mounted along each of the remaining three edges of the glass pane.

2. A door as defined in claim 1, characterized in that the torsion spring (11) has square cross-section.

3. A door as defined in claim 1 or 2, characterized in that a handle (5) for opening the door is attached directly to the glass pane located farthest away from the refrigerating or freezing chamber.

* * * * *